United States Patent [19]

Mayer et al.

[11] 4,221,098

[45] Sep. 9, 1980

[54] PROCESS FOR MAKING A LARGE POST-TENSIONED FLOOR BAY CONSISTING OF A NUMBER OF PREFABRICATED REINFORCED-CONCRETE FLOOR ELEMENTS

[75] Inventors: György Mayer; László Nemeskéri, both of Pécs, Hungary

[73] Assignee: Baranya Megyei Allami Epitoipari Vallalat, Pécs, Hungary

[21] Appl. No.: 886,590

[22] Filed: Mar. 14, 1978

Related U.S. Application Data

[62] Division of Ser. No. 801,366, May 27, 1977.

[51] Int. Cl.[2] ..... B21D 39/00; E04C 3/29

[52] U.S. Cl. ..... 52/741; 29/452; 29/460

[58] Field of Search ..... 52/79.1, 227, 741, 224, 52/225, 226; 264/227, 228; 29/452, 460

[56] References Cited

U.S. PATENT DOCUMENTS

| | | | |
|---|---|---|---|
| 1,404,710 | 1/1922 | Toupet | 52/438 |
| 2,101,538 | 12/1937 | Faber | 52/227 |
| 3,501,882 | 3/1970 | Kobayashi | 52/438 |
| 3,579,931 | 5/1971 | Lang | 264/228 |
| 3,639,973 | 2/1972 | Young | 29/452 |

*Primary Examiner*—John E. Murtagh

*Attorney, Agent, or Firm*—Young & Thompson

[57] ABSTRACT

The invention is a process for making a large post-tensioned floor bay consisting of a number of prefabricated reinforced-concrete floor elements.

The floor bays are composed of such floor elements, in which channels, optionally closed at the bottom, but open on top in any case, run along the whole length of the elements, the channels being broken by ribs provided with vertically oblong holes. The floor elements are assembled in a way such that the channels join each other. Cables spanning the elements along a straight line are laid in the channels, and the cables can be given the required eccentricity at the points where necessary. The cables thus made eccentric are fixed by the channels being filled with concrete.

No cable duct tubes are used and a single length of cable can be passed unbroken through several floor bays from wall to wall. Thus one-way or two-way load bearing floor bays can be formed.

1 Claim, 22 Drawing Figures

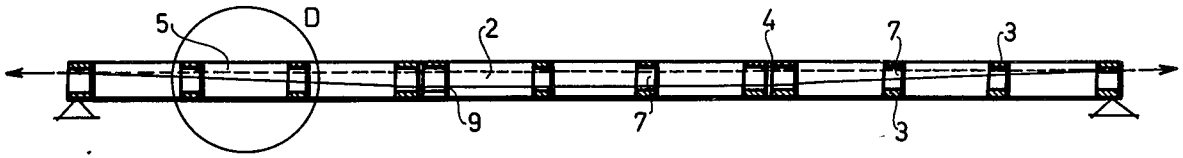
Fig. 4 F-F
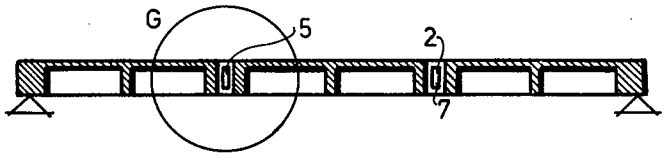
Fig. 5. E-E

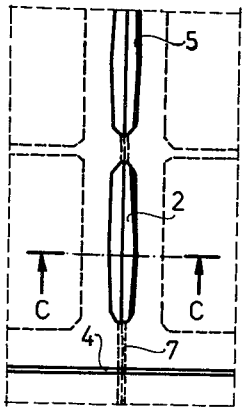
Fig.6 B
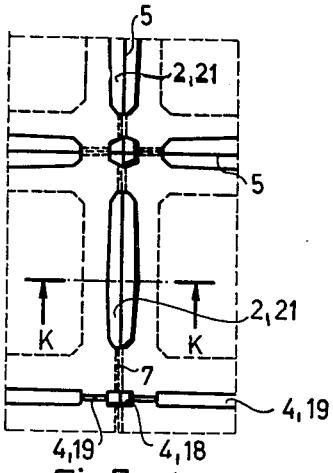
Fig.7 J
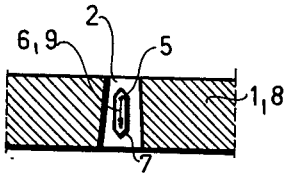
Fig.8 C-C
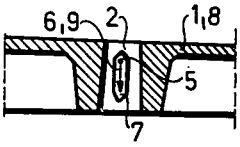
Fig.9 G-G
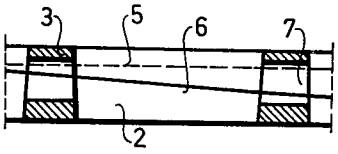
Fig. 10 D
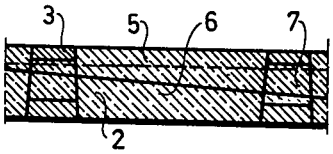
Fig. 11
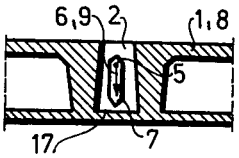
Fig.12 K-K
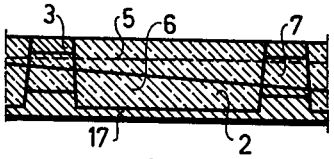
Fig. 13

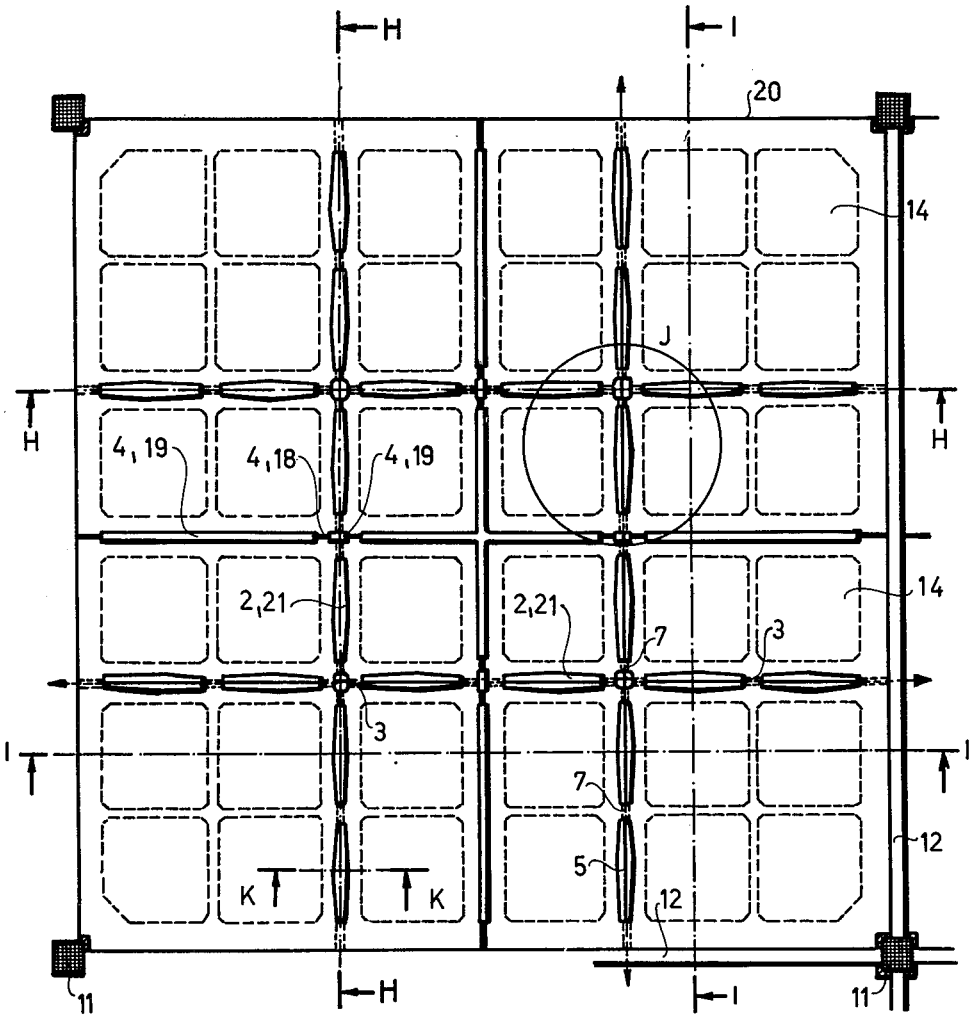
Fig.14
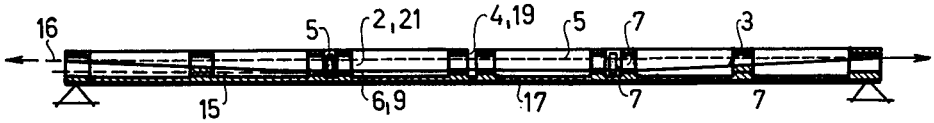
Fig.15 H-H
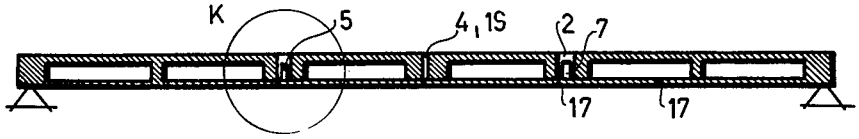
Fig.16 I-I

PROCESS FOR MAKING A LARGE POST-TENSIONED FLOOR BAY CONSISTING OF A NUMBER OF PREFABRICATED REINFORCED-CONCRETE FLOOR ELEMENTS

This is a division of application Ser. No. 801,366, filed May 27, 1977.

The object of the invention is a process for producing a large post-tensioned floor bay consisting of a number of prefabricated reinforced-concrete floor elements.

The floors of residential and public buildings are generally expected to cover as large areas as possible, to have plane surfaces above and beneath, with a minimum of structural height, to possess proper load capacity, to be economical as regards material consumption, their deformations and deflections under dead weight and working loads to be slight, and to be adapted for prefabrication and for use in mounted constructions.

Several of the above requirements are contradictory from them, we wish to point out the incompatibility of long spans with prefabrication and transportability. Standard prefabricated elements do not meet the requirement of having plane surfaces on top and at the bottom alike, because wide spans will need beams either in the form of floor ribs, or in that of main beams.

The floor bays of the known prefabricated skeletons that cover large areas consist of main beams that join the pillars and run in the same direction plus one-way bearing-free floor elements located perpendicularly to the former.

A procedure of the construction of plane floors consisting of two elements, with the jointing of the elements through spanning by moment-bearing joints is known. According to it, the elements are fabricated by twos, united by dry jointing, and the flexural moment arising at the junctions of the two elements is taken up by spanned cables in tubes filled with concrete, called cable duct tubes, along arched paths (at bearers on top, at joints under the middles of the spans) and spanned. This process has several drawbacks: the precise jointing of the tubes requires dry rafting and the manufacturing of twin elements side-by-side to render this possible; in addition, every bearer bay, that is to say, every couple of elements requires separate spanning and anchoring because of the frictional resistance of the bent tube ducts accommodating the cables. A checking of the tension after anchoring of the cables laid in the pipes is impracticable, and the required injecting of the tubes is another operation requiring high reliability, yet difficult to check. We wish to note that the procedure outlined above is a solution devised on the analogy of big structures only (bridges, halls) and that, to the best of our knowledge, it has not been put into practice so far.

Another known process is to cause post-tensioned large-sized floor elements to join the pillars at the four corners of the elements (through friction obtained by spanning), where tensioning cables traversing the pillars run in the joints between the floor elements and, together with the border beams form post-tensioned trimmer systems. The cables can be laid along a straight line and spanned, then the eccentricity needed can be produced in the free (open) joints of the floor elements by spanning down. Considerations to the possibility of transportation and lifting in, however, limit the sizes of such floor bays to 20 to 25 $m^2$ area as a maximum.

The procedure according to the invention permits the construction of continuous floor bays and pillar networks larger than that, up to 40–50 $m^2$, or even 80 $m^2$ surface areas. According to the invention the one-way or two-way load bearing floor bays are constructed of several floor elements, each floor element,—though being adapted to be fabricated singly and each forming a load bearing unit also when mounted—permit spanning and lending of eccentricity in channels provided in the bodies of the floor elements and, at least, partly open, this resulting from their quite novel design.

The essence of the development is that the elements are traversed by channels of full structural height, open on top and at the bottom, or only on top (like a trough) which, though at some places broken by ribs provided to secure the unity of the floor element, permit the required straight tracing of the cables, as well as giving them eccentricity by spanning down, the ribs being traversed by holes made to the purpose. The floor elements are joined preferably by wet rafting, thus the joining gaps of the elements can be entirely filled with concrete or, alternatively, the narrow gaps provided along the cable ducts may be filled with some quick-setting material (e.g. epoxy resin, polyurethane etc.), the wider gap after spanning being then filled with concrete through its entire width. Both the cable channels and the holes in the ribs are so dimensioned as to be adapted to be filled with concrete, and the concrete layer completes the floor panel to come up to full load capacity, on the one hand, and fastens the cables with their eccentricity, while providing them protection from corrosion, on the other. The spanning of the cables in the open channels can be checked by standard wave oscillation frequency instrument. In the channels the cables can be laid from one end of the building to another, spanned and eccentricity given to them. As a result a statically most favourable continuous system is brought about. The channels may alternatively cross each other, producing in this case two-way load bearing and two-way continuous systems.

It is clear that the floor bay and its production process according to the invention have several novel additional advantages that cannot be secured by the known processes of the same purpose.

The invention will be described below in some detail, with reference to drawings and examples of implementation. The drawings, while representing advantageous variants of implementation, give illustrative examples also of the reinforced-concrete floor panels and of the floor bays produced from them by spanning.

FIG. 4 is Section F—F of FIG. 3, a section across the cable duct;

FIG. 5 is Section E—E, FIG. 3, perpendicular to the cable duct (parallel to the matching plane of the elements), representing the cross section of the cable duct;

FIG. 6 is Detail B of the floor plans of FIGS. 1 or 3, showing the section indicated of the floor plans to a larger scale;

FIG. 7 is Detail J to a larger scale of FIG. 14, representing the junction of the elements together with the cable ducts crossing each other in case the floor elements are combined to give two-way bearing;

FIG. 8 is Section C—C of FIGS. 1 or 6, representing the cable duct to a larger scale, showing the locations of the holes made in the ribs, the cable laid in it on top and the direction of eccentricity pointing downward;

FIG. 9 represents Section G—G according to the notation of the floor plan, FIG. 3, or Section E—E, FIG. 5; it also corresponds to Section C—C but in case of a floor element ribbed at the bottom;

FIG. 10 is a representation of Section D, FIGS. 2 or 4, to a larger scale, showing the section of two ribs across the holes made in them and the possible laying of the cable;

FIG. 11 is a section similar to that in FIG. 10, with the difference that the latter shows it filled with concrete;

FIG. 12 is Section K—K, FIG. 14, or Detail K of, FIG. 16, showing a cable duct for floor element, with cavities, flat on top and at the bottom, produced by the known procedure, the cable duct itself being closed at the bottom by a ceiling layer of concrete;

FIG. 13 shows a cable duct corresponding to preceeding FIG. 12, filled with concrete, but for the case of a cable duct closed at the bottom by a layer of concrete;

FIG. 14 illustrates a two-way bearing floor bay assembled of four elements, which joins the pillars by the known technique, in the plane of the pillars, through post-tensioned bearers formed in the joints of the edge beams; here the principle of jointing and construction is represented by a variant of implementation represented in some detail;

FIG. 15 is Section H—H of FIG. 14, repreeenting cable ducts open only on top, perpendicular to each other, as longitudinal and cross sections;

FIG. 16 is Section I—I of the floor plan, FIG. 14, a general section of two joined floor elements produced by the known methods and containing closed cavities; the Figure additionally gives the cross section of the cable duct making connection in the other direction;

Figure 1:
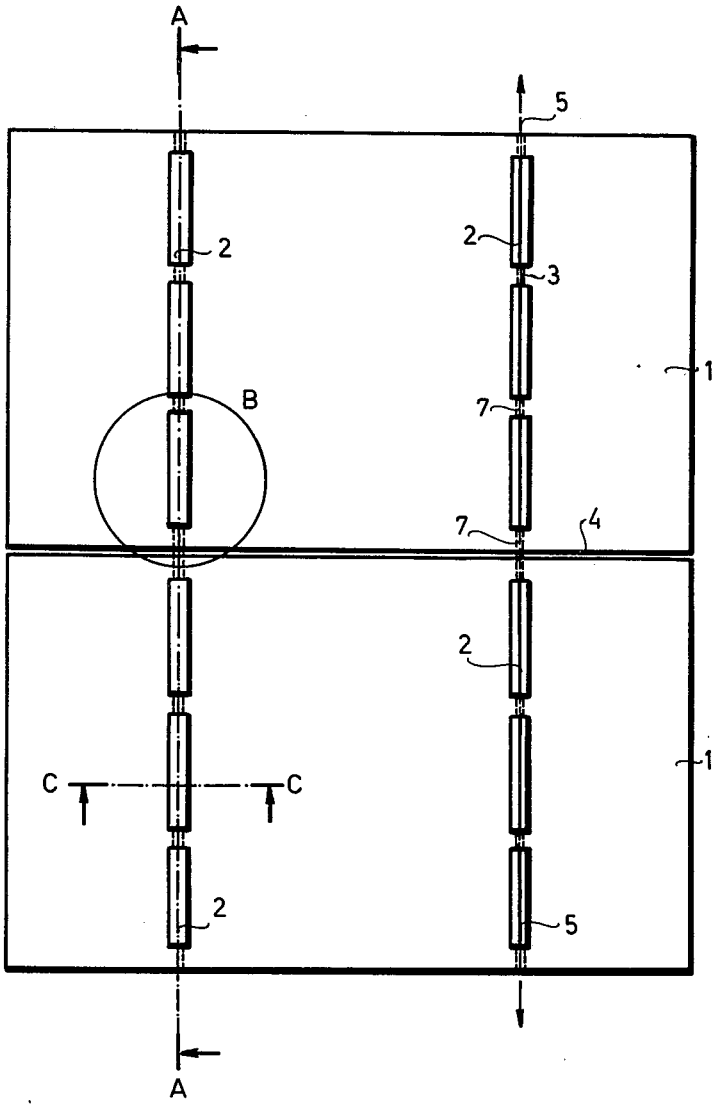
FIG. 1 shows the layout of two joined floor elements according to the invention, in a floor plan, as a top view, with the top views of the open cable ducts.
Figure 2:
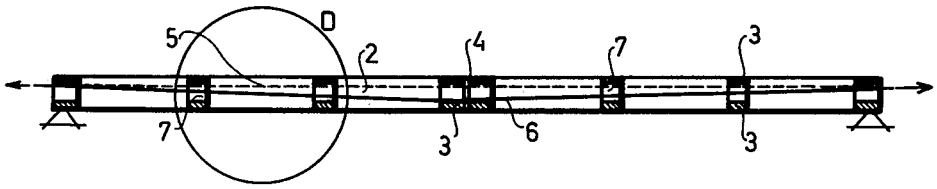
FIG. 2 represents the two elements along the straight line A—A indicated in FIG. 1, that is to say, in a section through the cable duct, side-by-side with the laying of the spanning cable that produces the junction.
Figure 19:
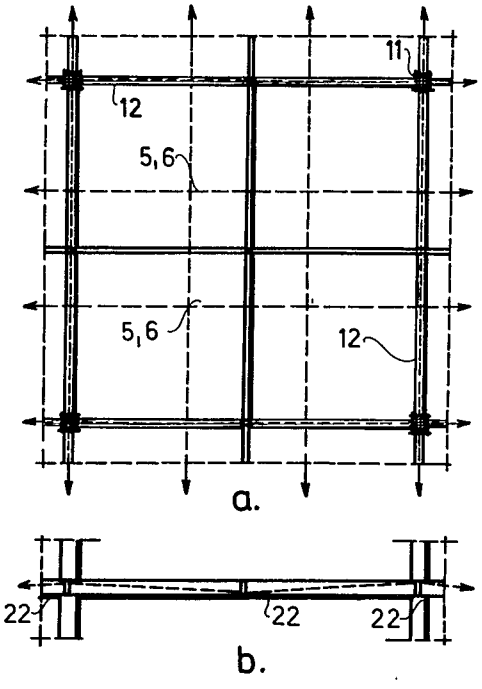

FIGS. 17*a* and 17*b* are representations of the fundamental case corresponding to the floor plan, FIG. 1, and section of FIG. 2, in a continuous system, where the element bears against a wall or a reinforced-concrete trimmer;

FIGS. 18*a* and 18*b* show the junction of two elements according to the preceding figures, yet inserted in a floor plan system in which the edges of the elements not joining one another form post-tensioned bearers fixed to the pillars in the planes of the pillars; in this case jointing by spanning gives continuity to the floor bays in one direction, while a border bearer system made according to the known procedure may be continuous also in two directions according to the interpretation of the Figure;

FIGS. 19*a* and 19*b* represent a floor bay made of four elements, according to the floor plan, FIG. 14 and section of FIG. 15, in a system continuous in two directions and additionally making part of a trimmer system continuous also in the pillar planes (produced by the known process).

Figure 3:
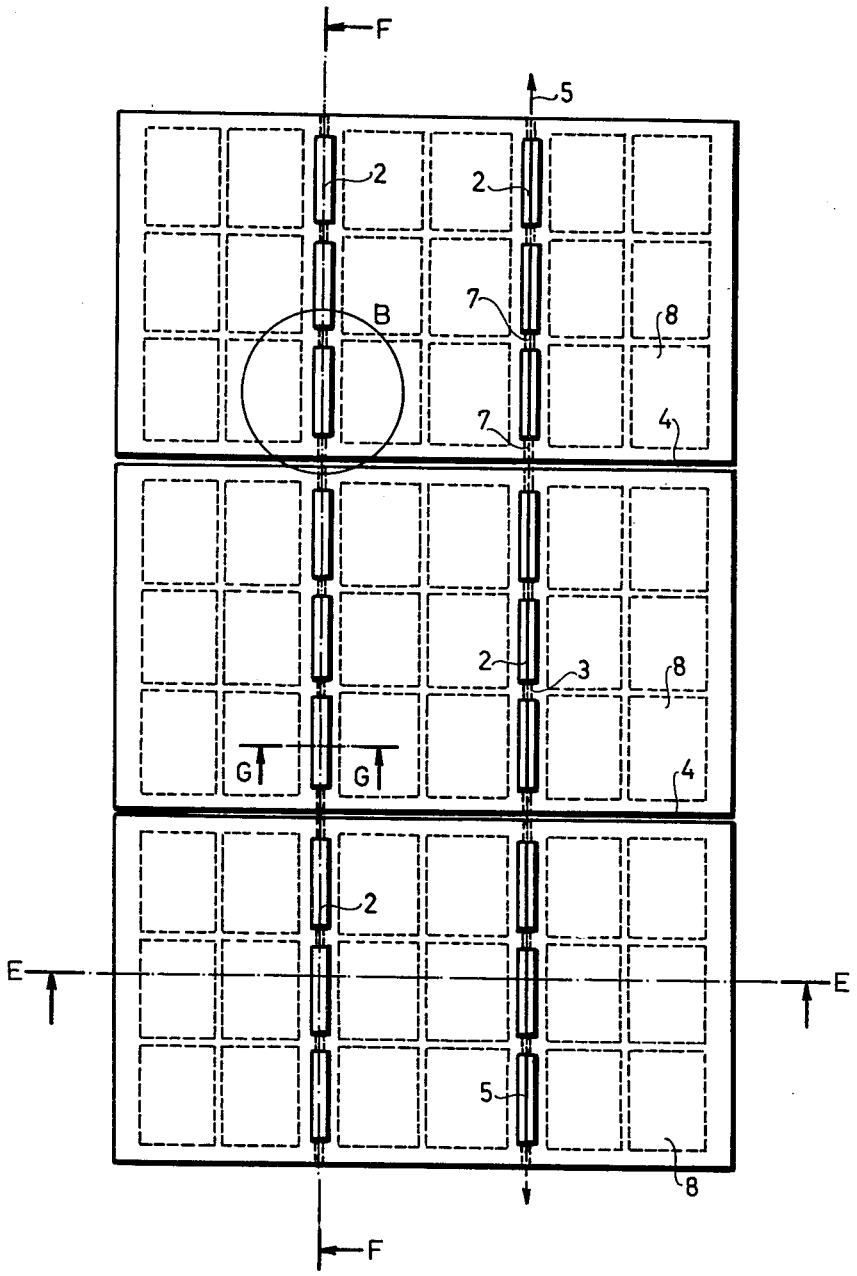
FIG. 3 is the floor plan (top view) of a floor bay constructed of three elements.

Let us now consider the details of the figures. FIGS. 1, 3 and 14 represent floor bays formed of floor elements. Floor elements 1 shown in FIG. 1 contain open ducts 2, bridged over by ribs 3 traversed by holes 7, oblong in vertical direction. The holes are shown in detail in Section C—C, FIG. 8. As a consequence of bridging ribs 3, floor element 1 forms a comprehensive whole and can be prefabricated as a reinforced-concrete floor element by the conventional methods. To make a floor bay as in the example according to FIG. 1 two floor elements 1, and in the example according to FIG. 3, three floor elements 8 are fitted together by their junctions 4. The junctions are filled with some quicksetting material—for instance with polyurethane or epoxy resin, etc.—and, contrary to usual techniques, the floor elements are jointed by wet rafting instead of dry jointing. It goes without saying that this operation is performed when the floor elements have been placed upon the auxiliary bearing structure on the site. When the plastic material has set, cables 5 are laid in ducts 2, and passed through the holes of ribs 3, without the use of any duct tube, along a straight line, then, when the cables have passed through the required number of floor elements—as many as needed to form the floor bay—the cables are spanned and, if they pass in the upper flange of the floor elements, the points junction are given the required eccentricity by spanning down with some suitable device. When the cables run in the lower flange, eccentricity is given to them at the points of support by spanning up. When this operation is finished, cables 6, having the eccentricity needed, are fixed by a temporary anchorage, then the ducts are filled with concrete. As a result, the cables run along the required line and are fastened in their position, permanently and definitively. Additionally, they are protected from corrosion. In FIG. 2, representing Section A—A of FIG. 1, the longitudinal section of cable duct 2 is clearly seen; ribs 3 are shown here in section, with holes 7 in them. Cable 5 is drawn in the upper flange by broken lines. The cable is given then the required eccentricity by its being spanned down in the vicinity of junction 4. Further on the cable is indicated as cable 6, drawn in full lines and having the required eccentricity. Detail B of FIG. 1 is repeated in FIG. 6 to a larger scale. Here, as an example, a part of a floor bay consisting of ribbed floor elements is shown. Naturally, if so required, massive concrete floor elements can alternatively be used, as illustrated in FIG. 8, identical with Section C—C, FIG. 1. In Section C—C, FIG. 8, cable 5 laid in the upper flange of hole 7 is additionally indicated; the location of cable 6, having received the required eccentricity by spanning down at spanning point 9 is indicated by an arrow.

The floor bay consisting of three floor elements 8, represented in FIG. 3, does not essentially differ from the floor bay composed of two floor elements 1, shown in FIG. 1. The special feature of the solution according to the invention is well illustrated by Section F—F, FIG. 4. Namely, in the known solutions, the cable duct tubes covered with concrete in advance in the floor elements are arched, owing to which the cables running in them cannot be used to join more than two floor elements to form a floor bay. Beyond this, the cables must be broken and anchored. On the contrary, in the solution according to the invention, cable 5 can be laid in the open ducts in lengths selected at will, along a straight line, and at the points of spanning down 9 the cable can readily be given the eccentricity needed. This is clearly seen in FIG. 4, in Section E—E, FIG. 5, and Section G—G, FIG. 9. Besides, FIGS. 8 and 9 differ only inasmuch as FIG. 8 represents a solid floor element, whereas that seen in FIG. 9 is ribbed. FIG. 10 gives Detail D of FIG. 4 to a larger scale. Cable 5, passed first through hole 7 in rib 3 is drawn in broken line. After it has received the eccentricity needed, the same cable, now marked as 6, takes up the required direction. In this position it is then fixed by the duct being filled with concrete, as illustrated in FIG. 11.

As mentioned, in the floor bay according to FIG. 14, for instance, such floor elements 14 can be applied, in which the bottoms of the ducts and cavities are covered with thin concrete layers 17, as seen in Section H—H, FIG. 15, and Section I—I, FIG. 16. Concrete layers 17 forms a uniform smooth ceiling and when, after the proper location of the cables and the lending of the eccentricity needed to them, the ducts are filled with concrete, the layer 17 makes the bottom closing of the duct superfluous, filling with concrete can be performed in a most simple way, as indicated in FIG. 13. FIG. 7 is a Detail J of FIG. 14 to a larger scale; FIG. 12 illustrates Section K—K. The latter is easily understood on the basis of those described above, without any additional explanation.

In FIGS. 1 and 3 junctions 4 are represented as gaps running uniformly along the entire length between the floor elements. In order to obtain the proper spanning of the cable, however, it is better to form the narrow gaps 18 only in the proximity of the joining ends of ducts 2 aligned with each other and of ducts 21 crossing each other —as represented in FIG. 14—consisting of embossments at the edges of the floor elements, and to make wider ducts 19 at the intermediate parts, as seen in FIG. 14. Naturally, when there is a single duct only and, following from this, a single embossment in the proximity of the edge, in order to obtain the narrow gap 18, at least one additional embossment should be provided at the edge of the floor bay, so that the two floor elements can properly be joined by spanning and to enable them to take up the compression force arising from spanning, also preventing them from being displaced. With such design, only the narrower gaps 18 are filled with some quick-setting material before the cables are laid in and spanned, then, when the cables have been laid and the required eccentricity has been given to them, the ducts 19 between the elements are filled with concrete.

While floor elements 1 and 8, represented in FIGS. 1 and 3, respectively, contain two ducts 2 of a single direction each—a single duct 2 equally would do—each of the floor elements 14, represented in FIG. 14 has two ducts 21 crossing each other. Following from this, also the cables will cross in the floor bay. FIG. 15, Section H—H of FIG. 14, representing the section of a duct shows how two cables can cross each other. Besides, FIG. 14 indicates the standard joining of the floor bay and pillar 11, where the load bearing capacity required over the distances between supports 12 is obtained by the cable led and given the eccentricity needed by spanning down. FIG. 15 represents cable 5 adjacent the upper flange, to be given eccentricity and transformed into cable 6, by spanning down at point 9, as well as cable 15 adjacent the lower flange which, after being spanned up at the point of support 16, is transformed into cable 6, equally eccentric.

Figure 17:
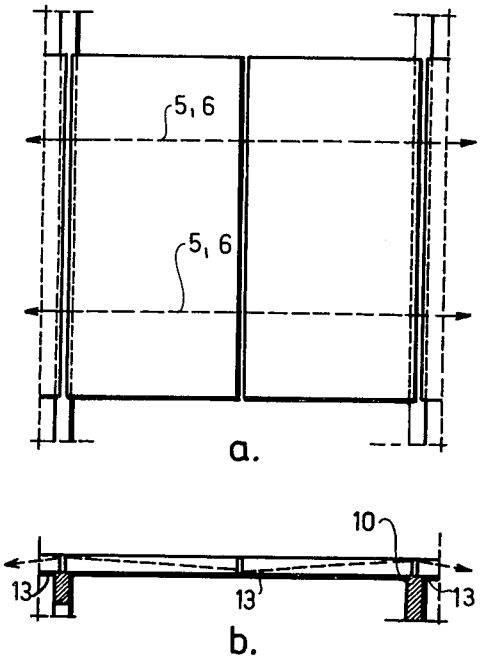
Figure 18:
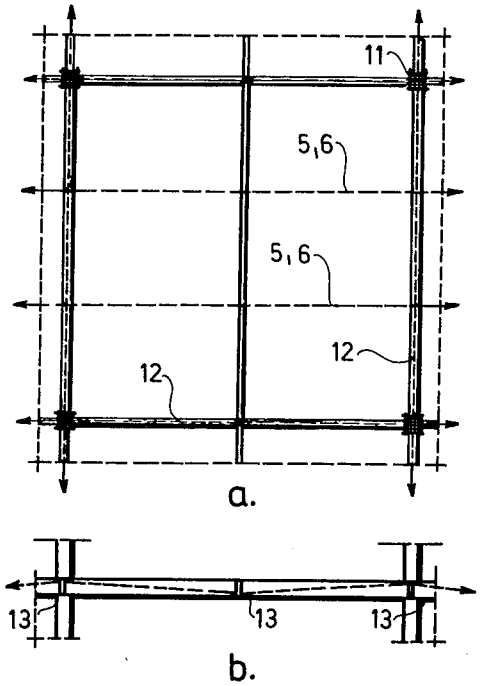

FIGS. 17*a* and *b*, 18*a* and *b*, 19*a* and *b* represent the fitting into a continuous system of the floor bay according to the invention. In FIG. 17, support is given by wall 10, of full width, or by a suitable reinforced-concrete bearer; load carrying spanning takes place over the distances between supports, while cable 5, and when the required eccentricity has been given to it, cable 6, can be led through all bays, from wall to wall. In FIG. 18, the edges not joining each other of the floor elements form post-tensioned bearers in the pillar planes through which they join the pillar frames. Finally, in FIG. 19, a part of a system, continuous in two directions plus in the pillar planes, is demonstrated. For every case it is characteristic that the cables can pass along the entire lengths of the continuous systems.

As seen from the above, the procedure according to the invention dispenses with the laying of the cables in tubes, which eliminates the necessity of using short cable lengths, thus providing the possibility of the construction of floor bays composed of more than two elements and having two-way load bearing capacity; in addition, it permits the wet rafting of the floor elements, without the requirement of manufacturing the elements by twos.

What we claim is:

1. Process for the construction of a reinforced concrete floor, comprising assembling a plurality of prefabricated concrete floor elements in edge-to-edge coplanar relationship with a plurality of said elements in a common plane in each orthogonal direction, each said element having a duct formed in the concrete thereof which extends substantially full length of the element parallel to but spaced between the sides of the element and which is at least upwardly open, at least one of said elements having a plurality of said ducts therein at right angles to each other thereby to form in the assembly of elements a plurality of series of aligned ducts with at least two of said series intercepting each other at right angles, each element having at least one integral rib bridging said duct, each said series extending entirely across said floor, each rib having a hole extending horizontally therethrough, each duct communicating at at least one end thereof with at least one duct of at least one adjacent said element, feeding a cable through said ducts and through said holes through said bridges with the cable passing entirely through one said series of ducts at right angles to said one series of ducts, then passing the same said cable through another said series of ducts, whereby the same said cable extends entirely through a plurality of said series of ducts, and thereafter anchoring the ends of the cable and deflecting a portion of said cable intermediate its ends in a direction perpendicular to the plane of said elements whereby different portions of said cable are inclined at opposite angles to said plane, and then filling said ducts with concrete.

* * * * *